US011823560B2

(12) United States Patent
Jones et al.

(10) Patent No.: US 11,823,560 B2
(45) Date of Patent: Nov. 21, 2023

(54) MULTI-FUNCTION BUTTON OPERATION IN A MOVEABLE BARRIER OPERATOR SYSTEM

(71) Applicant: GMI Holdings, Inc., Mt. Hope, OH (US)

(72) Inventors: Joshua S. Jones, Fredericksburg, OH (US); Robert E. Thomas, Jr., Flower Mound, TX (US); Walter J. Connare, Dover, OH (US)

(73) Assignee: GMI HOLDINGS, INC., Mount Hope, OH (US)

( * ) Notice: Subject to any disclaimer, the term of this patent is extended or adjusted under 35 U.S.C. 154(b) by 0 days.

(21) Appl. No.: 17/673,616

(22) Filed: Feb. 16, 2022

(65) Prior Publication Data

US 2023/0260391 A1 Aug. 17, 2023

(51) Int. Cl.
*G08C 17/02* (2006.01)
*G07C 9/10* (2020.01)

(52) U.S. Cl.
CPC ..... *G08C 17/02* (2013.01); *G07C 9/10* (2020.01)

(58) Field of Classification Search
CPC ..... G08C 17/02; G07C 9/10; G07C 9/00896; G06K 9/3258
See application file for complete search history.

(56) References Cited

U.S. PATENT DOCUMENTS

| | | | | |
|---|---|---|---|---|
| 4,847,542 | A | 7/1989 | Clark et al. | |
| 4,929,877 | A | 5/1990 | Clark et al. | |
| 5,751,224 | A | 5/1998 | Fitzgibbon | |
| 6,081,203 | A | 6/2000 | Fitzgibbon | |
| 6,414,587 | B1 | 7/2002 | Fitzgibbon | |
| 6,975,203 | B2 | 12/2005 | Brookbank et al. | |
| 7,262,572 | B2 | 8/2007 | Fitzgibbon | |
| 7,397,342 | B2 | 7/2008 | Mullet et al. | |
| 10,087,673 | B1 * | 10/2018 | Rosenmarkle | E05F 15/60 |
| 10,443,296 | B2 | 10/2019 | Rosenmarkle et al. | |
| 10,846,960 | B1 * | 11/2020 | Lemberger | H04N 7/183 |
| 2002/0126037 | A1 | 9/2002 | Fitzgibbon | |
| 2004/0257199 | A1 | 12/2004 | Fitzgibbon | |
| 2008/0012515 | A1 * | 1/2008 | Murray | G07C 9/00174 318/282 |
| 2009/0195162 | A1 | 8/2009 | Maurer et al. | |
| 2011/0316668 | A1 | 12/2011 | Laird et al. | |
| 2016/0165679 | A1 * | 6/2016 | Laherty | H05B 45/10 315/294 |

* cited by examiner

*Primary Examiner* — Vernal U Brown
(74) *Attorney, Agent, or Firm* — HAYNES AND BOONE, LLP

(57) ABSTRACT

A moveable barrier system may include a moveable barrier configured to provide selective access to a space; a barrier operator configured to manipulate the moveable barrier between a closed position and an open position; a light; and a control station comprising a multi-function button configured to initiate more than one action by the barrier operator and by the light, the multi-function button being configured to initiate actions of: stopping an auto-close timer in response to receiving a first user input at the multi-function button; and toggling the light between an off state and an on state in response to receiving a second user input at the multi-function button.

20 Claims, 4 Drawing Sheets

MULTI-FUNCTION BUTTON OPERATION IN A MOVEABLE BARRIER OPERATOR SYSTEM

TECHNICAL FIELD

The present disclosure relates generally to the field of moveable barrier operator systems. In particular, a single multi-function button may be used to perform at least one first function, and in addition, toggle a light fixture between an "on" and an "off" status.

BACKGROUND

Moveable barriers, such as upward-acting sectional or single panel garage doors, residential and commercial rollup doors, and slidable and swingable gates, are used to alternatively allow and restrict entry to building structures and property. These barriers are driven between their respective open and closed positions by motors or other motion-imparting mechanisms, which are themselves controlled by barrier moving units, sometimes referred to as "moveable barrier operators," and in the specific case of a door, as "door operators," and in the even more specific case of a garage door, as "garage door operators." Garage door operators are effective to cause the DC or AC motor, and accompanying motor drive assembly, to move the associated garage door, typically between its open and closed positions.

Typically, a barrier operator is in communication with a work light and a control station. The light can be mounted to the barrier operator or at another location, such as mounted to a ceiling near the barrier. The light is used to illuminate the area near the barrier. The control station is mounted on a wall within reach of a user. The control station typically includes multiple buttons for receiving user inputs. For example, an open button may send a signal to the barrier operator causing it to move the barrier from a closed position to an open position. A close button sends a similar signal moving the barrier from an open to a closed position. A stop button may stop the movement of the barrier before the barrier assumes either an open or closed position.

The control station may include additional buttons serving additional functions. For example, a light button may control whether the work light is on or off. The barrier operator may also start and maintain an auto-close timer. The auto-close timer may determine the time that the barrier has remained in the open position. If the barrier has been in the open position for a period of time exceeding a threshold, the barrier operator may close the barrier automatically. The control station may include a button to stop this auto-close timer.

These multiple functions of the barrier operator in conjunction with the control station may correspond to multiple buttons or other user inputs positioned on the control station. This results in the control station being large and requiring more space on a wall. As additional functions and corresponding buttons are added, operation of the control station also becomes more complex and less intuitive.

It is therefore among the objectives of the implementations of the multi-function button barrier operation system and method disclosed herein to present a new and improved version of such system and method that is compact, simplified, and easy to use.

SUMMARY

In an example aspect, the present disclosure is directed to a moveable barrier system. The moveable barrier system may include a moveable barrier configured to provide selective access to a space; a barrier operator configured to manipulate the moveable barrier between a closed position and an open position; a light; and a control station comprising a multi-function button configured to initiate more than one action by the barrier operator and by the light, the multi-function button being configured to initiate actions of: stopping an auto-close timer in response to receiving a first user input at the multi-function button; and toggling the light between an off state and an on state in response to receiving a second user input at the multi-function button.

In an aspect, the multi-function button is configured to further initiate an action of stopping a movement of the moveable barrier in response to receiving a third user input at the multi-function button. In an aspect, the control station is configured to send a signal to the barrier operator in response to receiving the first user input; and the barrier operator is configured to stop the auto-close timer in response to receiving the signal from the control station. In an aspect, the control station is configured to send a signal to the barrier operator in response to receiving the first user input; and the barrier operator is configured to stop the auto-close timer in response to receiving the signal from the control station. In an aspect, the control station is configured to send a first signal to the barrier operator in response to receiving the second user input; the barrier operator is configured to send a second signal to the light in response to receiving the first signal from the control station; and the light is configured to toggle between the off state and the on state in response to receiving the second signal from the barrier operator. In an aspect, the control station is configured to send a signal to the light in response to receiving the second user input; and the light is configured to toggle between the off state and the on state in response to receiving the signal from the control station. In an aspect, the control station is a control station. In an aspect, the control station is a remote input device configured to wirelessly communicate with the barrier operator. In an aspect, the light is configured to wirelessly communicate with the barrier operator. In an aspect, the barrier operator is further configured to automatically start the auto-close timer after moving the moveable barrier to the open position. In an aspect, the multi-function button is one of a physical button and a selectable image on a display.

In another example aspect, the present disclosure is directed to a moveable barrier system. The moveable barrier system may include a moveable barrier configured to provide selective access to a space; a barrier operator configured to manipulate the moveable barrier between a closed and an open position; a light; and a control station comprising a multi-function button configured to initiate more than one action by the barrier operator and by the light, the multi-function button being configured to initiate actions of: stopping a movement of the moveable barrier in response to receiving a first user input at the multi-function button; and toggling the light between an off state and an on state in response to receiving a second user input at the multi-function button.

In an aspect, the multi-function button is configured to further initiate an action of stopping an auto-close timer in response to receiving a third user input at the multi-function button. In an aspect, the control station is configured to send a signal to the barrier operator in response to receiving the first user input; and the barrier operator is configured to stop the movement of the moveable barrier in response to receiving the signal from the control station. In an aspect, the control station is configured to send a first signal to the barrier operator in response to receiving the second user input; the barrier operator is configured to send a second signal to the light in response to receiving the first signal from the control station; and the light is configured to toggle between the off state and the on state in response to receiving the second signal from the barrier operator. In an aspect, the control station is configured to send a signal to the light in response to receiving the second user input; and the light is configured to toggle between the off state and the on state in response to receiving the signal from the control station.

In another example aspect, the present disclosure is directed to a method. The method may include receiving a user input at a control station in operative communication with a barrier operator; in response to the user input, determining: a status of a moveable barrier configured to be manipulated by the barrier operator between an open position and a closed position; a status of an auto-close timer corresponding to a length of time until the barrier operator closes the moveable barrier; and in response to determining that the moveable barrier is stationary and determining that the auto-close timer is inactive, toggling a light between an off state and an on state.

In an aspect, the method may include stopping a movement of the moveable barrier in response to the user input. In an aspect, the method may include stopping the auto-close timer in response to the user input. In an aspect, the user input is received via a button of the control station. In an aspect, the user input is received via a common input mechanism.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any implementation or aspect may be combinable with one or more features of other implementation or aspect.

BRIEF DESCRIPTION OF THE DRAWINGS

The accompanying drawings illustrate implementations of the systems, devices, and methods disclosed herein and together with the description, serve to explain the principles of the present disclosure.

Figure 1:
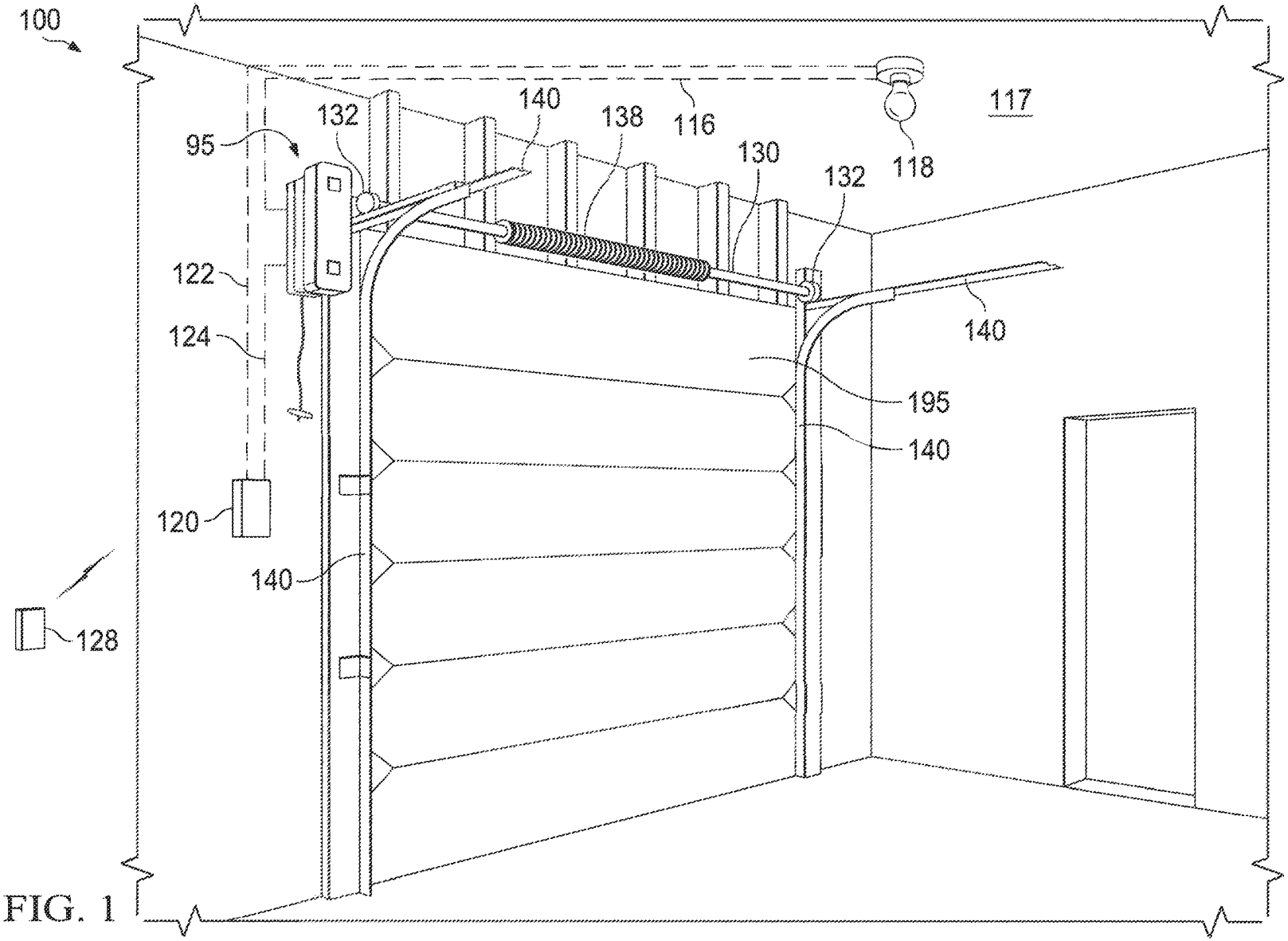
FIG. 1 is a perspective illustration of a moveable barrier system including a control station for moving an upward acting sectional type garage door.

These Figures will be better understood by reference to the following Detailed Description.

DETAILED DESCRIPTION

For the purpose of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

FIG. 1 is a perspective illustration of an example barrier system 100 including a control station for moving a moveable barrier. In this example, the moveable barrier is an upward acting garage door. In some examples, the moveable barrier may be a sectional type garage door. FIG. 1 illustrates a moveable barrier 195, a barrier operator 95, a light fixture 118, and a control station 120.

In some implementations, the barrier system 100 described herein may be referred to as a moveable barrier system, a door system, a garage door system, a gate system, or any other similar term. In some implementations, the moveable barrier 195 may be referred to as a barrier, a door, a garage door, a sectional garage door, an upward acting garage door, a gate, a moveable gate, a sliding gate, or any other similar term. In some implementations, the barrier operator 95 may alternatively be referred to as an operator, a door operator, a garage door operator, a gate operator, an opener, a door opener, a garage door opener, a gate opener, a control system, or any other similar term. In some implementations, the light fixture 118 may be referred to as a light, a light system, or any other similar term. In some implementations, the control station 120 may be referred to as a wall console, a controller, a barrier opener, a door opener, a garage door opener, a control panel, a multi-function control panel, a console, barrier console, a door console, a garage door console, an opener control, or any other similar term.

FIG. 1 shows that the moveable barrier 195 provides access to a space or a room having a ceiling 117 and the light fixture 118 that is spaced from the barrier operator 95. The moveable barrier 195 may provide selective access to the space. The barrier operator 95 may be any suitable type of barrier operator. For example, in some implementations, the barrier operator 95 may be a jackshaft operator. In other implementations, the barrier operator 95 may be a direct drive wall mounted operator, a belt driven operator, a chain driven operator, a screw drive operator, a trolley operator, a carriage operator, or any other type of barrier operator. The barrier operator 95 may include any suitable components. As shown in FIG. 1, the barrier operator 95 may be disposed adjacent the moveable barrier 195. For example, in the implementation shown, the barrier operator 95 may be positioned on the same wall as the opening covered by the moveable barrier 195. However, the barrier operator 95 may be positioned at any other location within the room shown in FIG. 1. For example, the barrier operator 95 may be affixed to the ceiling 117. In some implementations, the barrier operator 95 may be positioned on a different wall of the room or on the floor of the room. In some implementations, particularly in an implementation in which the barrier operator 95 is affixed or otherwise positioned on the ceiling 117 of the room, the light fixture 118 may be attached to, or a part of, the barrier operator 95. In the implementation shown in FIG. 1, the barrier operator 95 may not be positioned in a location of the room that is convenient for illuminating a large portion of the room or that may be visible from a large portion of the room. Thus, the effectiveness of the light fixture 118 used with a wall-mounted operator, such as the barrier operator 95, may be increased by locating the light fixture 118 at a location remote from the barrier operator 95. As shown, the light fixture 118 may be disposed on the ceiling 117 in a location more appropriate for lighting. Although FIG. 1 shows the light fixture 118 located on a ceiling of the room, in other implementations, the light fixture 118 may be disposed anywhere desired remote from the barrier operator 95. In some implementations, the light fixture 118 is disposed on a wall. In some implementations, the light fixture 118 is disposed on the room exterior instead of the room interior. In some implementations, the system may include multiple light fixtures 118 disposed in appropriate locations.

The light fixture 118 may be in wireless or wired communication with any of the other components of the barrier system 100 disclosed. For example, as shown by the line 116 of FIG. 1, the light fixture 118 may be in operative communication with the barrier operator 95. This communication may be achieved via one or more conductive wires from the barrier operator 95 to the light fixture 118. In such an implementation, the conductive wires illustrated by the line 116 may include wires configured to provide electrical power, such as 120 V AC power, to the light fixture 118. In other implementations, the conductive wires shown by the line 116 may carry other electrical signals, such as sending or receiving various commands, responses, or data. In some implementations, the line 116 of FIG. 1 may alternatively illustrate a wireless communication between the barrier operator 95 and the light fixture 118. In such an implementation, the light fixture 118 is a wirelessly activated remote light fixture that may include a work light. In addition, the light fixture 118 in any implementation may also include an audible speaker or sounder (e.g., a device configured to emit acoustic energy). A remote implementation of the light fixture 118 may be wirelessly activated via a corresponding wireless signal system described in more detail with reference to FIG. 2. The light fixture 118 may be wirelessly activated using a local network such as a Bluetooth network, although other local wireless communication methods may be used. A remote implementation of the light fixture 118 may be powered from a 120V AC main but may be controlled through a Bluetooth low energy (BLE) radio link to the barrier operator 95.

Like the communication between the barrier operator 95 and the light fixture 118, as illustrated by the line 116, the light fixture 118 may additionally or alternatively be in operative communication with the control station 120. This operative communication may be illustrated by the line 122. In an implementation in which communication between the control station 120 and the light fixture 118 is achieved via a wired communication, the line 122 may illustrate one or more conductive wires from the control station 120 to the light fixture 118. This wired communication may include any features or characteristics described with reference to a wired communication between the barrier operator 95 and the light fixture 118 described previously. In addition, in an implementation in which communication between the control station 120 and the light fixture 118 is achieved wirelessly, such a communication may include any of the features or characteristics described with reference to a wireless communication between the barrier operator 95 and the light fixture 118 described previously.

As shown by the line 124, the control station 120 and the barrier operator 95 may also be in operative communication. The control station 120 may be configured to receive user inputs from a user of the barrier system 100. In this way, the control station 120 may include any suitable forms of input devices or components, as will be described in more detail with reference to FIG. 3.

In some implementations, the control station 120 may receive user inputs relating to the operation of the barrier system 100. For example, a user input received at the control station 120 may include a direction to move the moveable barrier 195 between a closed position and an open position. Moving a barrier (e.g., the moveable barrier 195) between a closed position and open position may include moving the barrier from a closed position to an open position as well as moving the barrier from an open position to a closed position. In response to receiving a user input, the control station 120 may transmit a signal to the barrier operator 95. This transmission of a signal may be done in any suitable way. For example, the control station 120 may include a button which, when depressed by a user, mechanically completes an electrical circuit of the barrier operator 95. A processor circuit of the barrier operator 95 may then interpret the completion of the circuit in any suitable way. In another example, the control station 120 may include various circuitry, such as a processor circuit, configured to detect when a user input is received, and transmit a signal to the barrier operator 95. Other forms of communication between the control station 120 and the barrier operator 95 are anticipated.

As described with reference to the light fixture 118 and the barrier operator 95, the control station 120 and the barrier operator 95 may be in wireless or wired communication as shown by the line 124. This communication, whether wired or wireless, may include any of the features or characteristics of the communication between the barrier operator 95 and the light fixture 118, as illustrated by the line 116, and/or any features or characteristics of the communication between the control station 120 and the light fixture 118, as illustrated by the line 122, as has been previously described.

In some implementations, the control station 120 may receive a user input. For example, a user input may include selecting a button of the control station 120. In some implementations, the button may be a multi-function button. In response to receiving this user input, the control station 120 may send a signal by the operative communication shown by the line 124, to the barrier operator 95. In response to receiving the signal from the control station 120, the barrier operator 95 may perform one or more of a number of functions. In some implementations, in response to receiving a signal from the control station 120, the barrier operator 95 may send a signal to the light fixture 118. In response to receiving the signal from the barrier operator 95, the light fixture 118 may toggle between an off and an on status. In some implementations, to toggle between an off and an on status may include switching from an off to an on status if the light fixture 118 is currently in an off status or switching from an on to an off status if the light fixture 118 is currently in an on status. An on status may also be referred to as an on state and an off status may also be referred to as an off state.

Additionally shown in FIG. 1 is a remote console 128. In some implementations, the barrier system 100 may additionally or alternatively include the remote console 128. The remote console 128 may perform any of the functions of the control station 120. In some implementations, the remote console 128 may be in wireless communication with the barrier operator 95 and/or the light fixture 118. In some implementations, the remote console 128 may be a handheld device. In some implementations, the remote console 128 may be an RF transmitter. In some implementations, the remote console 128 may be a device configured for Bluetooth communication. In some implementations, the remote console 128 may be a device configured for wireless internet communication (e.g., Wi-Fi communication). In some implementations, the remote console 128 may be a smart device. In some implementations, the barrier operator 95 may send status information relating to the moveable barrier 195 and/or the light fixture 118 to the remote console 128. For example, the remote console 128 may display whether the moveable barrier 195 is in an open or a closed position and whether the light fixture 118 is on or off. The remote console 128 may also be referred to as a remote input device.

Any suitable structures or components may be implemented to facilitate movement of the moveable barrier 195 between a closed position and an open position. In the example shown in FIG. 1, the moveable barrier 195 may be moved along one or more guide rails 140. Additionally shown in FIG. 1 is a shaft 130, cable drums 132, and a torsion spring 138.

FIG. 1 illustrates the moveable barrier 195 as an upward acting sectional door being moveable between open and closed positions along the guide rails 140. The guide rails 140 may be affixed to either side of the opening of the moveable barrier 195. In some implementations, the guide rails 140 may be affixed to the wall of the room shown in FIG. 1 and/or the ceiling 117. In some implementations, the moveable barrier 195 may include one or more rolling or sliding components on either side sized and shaped to fit within and move in a longitudinal direction along the guide rails 140.

In the example of a jack shaft operator implementation shown in FIG. 1, the barrier operator 95 may be adjacent a motor drive assembly which may include a shaft 130 and one or more cable drums 132 rigidly affixed to the shaft 130. These may be rotatably driven by a motor of the barrier operator 95. One or more cables may be wound about the cable drums 132 and have their free ends attached at or adjacent a bottom edge of the moveable barrier 195. In some implementations, the shaft 130 forms a part of, or is coaxial with, a motor shaft of the motor. In other implementations, the shaft 130 may be laterally offset from the motor shaft of the motor. Rotation of the output shaft of the motor rotates the shaft 130 and the cable drums 132. Rotation in a direction to wind the cable around the cable drums 132 results in the moveable barrier 195 being raised to the open position.

In some implementations, the shaft 130 of the motor drive assembly extends horizontally and is directly coupled to, and adapted to be rotatably driven by, the motor in either a clockwise or counterclockwise direction. A torsion spring 138 extends around the shaft 130 and may assist in reducing the rotational force to be exerted by the motor of the barrier operator 95 necessary to move the moveable barrier 195 between a closed positioned and an open position.

In other implementations, components of the barrier system 100 shown in FIG. 1 may include any other suitable components. For example, the barrier system 100 may include rollers positioned on the moveable barrier 195 or the guide rails 140. The system may include sensors, such as safety sensors configured to detect the presence or motion of an object or person, seals positioned along any portion of the moveable barrier 195 or the corresponding opening, tracks, cables, or tube shafts. The system may include extension springs to further reduce necessary rotational force of a motor, a motor rail, belts, motor head, motor arms, lift handles for manual operation, emergency release ropes, or any other suitable components.

Figure 2:
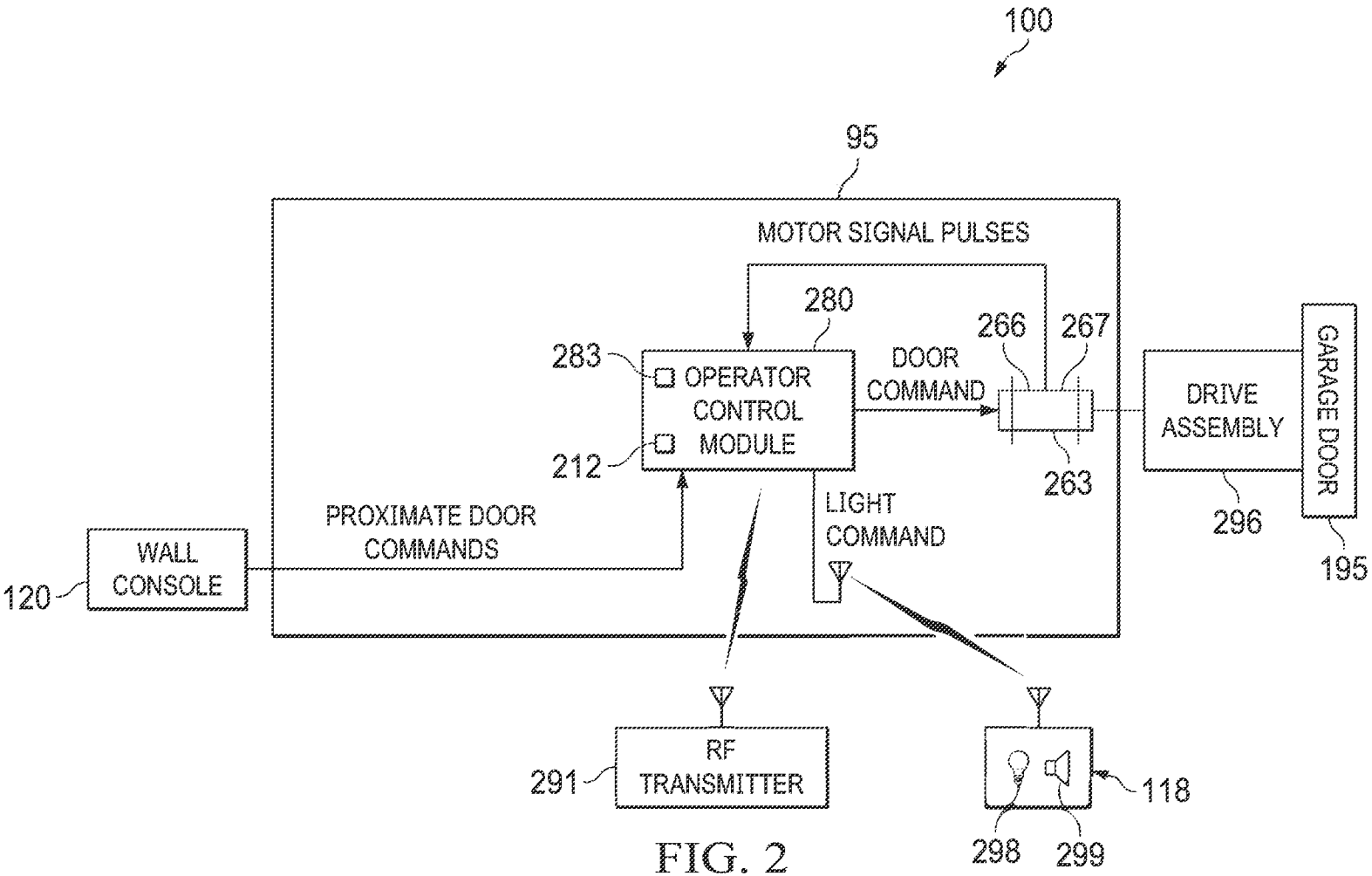
FIG. 2 is a block diagram of an implementation of a the moveable barrier system in accordance with the principles of the present invention.

FIG. 2 is a block diagram of one implementation of the control system in accordance with the principles of the present invention. FIG. 2 depicts a block diagram of the overall system, and interconnection of the principal components of the barrier system 100, incorporating the principles of the present invention. Accordingly, the barrier system 100 determines and monitors the status (e.g., closed/not closed or open/closed) of the moveable barrier 195, the status of an auto-close timer (e.g., active/not active or active/inactive), as well as effecting change of the status of the moveable barrier 195 utilizing, in some implementations, a barrier operator (e.g., the barrier operator 95). The barrier system 100 may also effect changes of the status of the auto-close timer.

FIG. 2 shows the barrier system 100 with the barrier operator 95, the wall console 120, an RF transmitter 291, the light kit or fixture 118, and a drive assembly 296 associated with the garage door 195. The barrier operator 95 includes a motor assembly 263 and an operator control module 280. The motor assembly 263 may include (i) a motor 267 adapted to move the moveable barrier 195, and (ii) an absolute position sensor 266 that monitors or measures the position of the moveable barrier 195. In some examples, the position sensor 266 may measure the position of the moveable barrier 195 based on the rotation of a motor shaft of the motor 267. The position sensor 266 may communicate signals based on the measurements indicative of the extent and direction of rotation of the rotatable output shaft of the motor 267 and therefore indicative of the extent and direction of travel of the moveable barrier 195 between travel limits.

The motor 267 is operatively coupled to a drive assembly 296. The motor 267 and the drive assembly 296 are effective to impart movement to the moveable barrier 195 in accordance with door commands remotely and/or proximately transmitted to the operator control module 280 and thereafter to the motor 267. The drive assembly 296 may be any of the standard and conventional drive assemblies available on the market that are suitable to move the moveable barrier 195 in response to the motor 267. In some implementations, the drive assembly 296 may include at least the cable drums 132, shaft 130, and torsion spring 138 shown and described with reference to FIG. 1.

In accordance with the overall operation of the barrier system 100, information from the absolute position sensor 266 indicative of the extent and direction of motor shaft rotation, and therefore the extent and direction (up or down) of the moveable barrier 195, are conductively transmitted by wire to the operator control module 280.

In some implementations, the operator control module 280 may be configured to maintain an auto-close timer. For example, a processor circuit of the operator control module 280 may initialize an auto-close timer at various times. The auto-close timer initialized by the operator control module 280 may include a programmable software or hardware timing device, a physical or mechanical timer, or any other type of device for measuring elapsed time. In one implementation, the operator control module 280 may be configured to initialize the auto-close timer at the time the moveable barrier 195 assumes an open position. The operator control module 280 may initialize the auto-close timer in response to receiving door status information from, e.g., the position sensor 266. The operator control module 280 may compare the elapsed time as measured by the auto-close timer to a pre-determined threshold time. In some implementations, a manufacturer of the barrier system 100 may determine this threshold time. In some implementations, a user of the barrier system 100 may determine this threshold time. When the operator control module 280 determines that the elapsed time as measured by the auto-close timer meets or exceeds the threshold time, the operator control module 280 may transmit a door command to the motor assembly 263 to move the moveable barrier 195 to a closed position. In some implementations, the operator control module 280 may be further configured to send alight command to the light fixture 118 when the elapsed time meets or exceeds the threshold. In such implementations, the light fixture 118 may be toggled to an on status or may be repeatedly toggled between an on and an off status in rapid succession to warn those in proximity to the moveable barrier 195 that the moveable barrier 195 will be moved to a closed position. In some implementations, the operator control module 280 may transmit an additional command to a sounder 299 of the light fixture 118 to emit a sound to additionally warn anyone of anticipated movement of the moveable barrier 195. In some implementations, the operator control module 280 may transmit the light command and/or sound command to the light fixture 118 before transmitting the door command to the motor assembly 263 or may transmit any of these commands simultaneously.

In accordance with one implementation, user-generated commands, such as toggle open/close commands, stop/start commands of the auto-close timer, and/or toggle on/off commands of the light fixture 118, may also be transmitted to the operator control module 280 from the control station 120 connected to the operator control module 280 via a connector. As shown in FIG. 2, the operator control module 280 may include a microcontroller 283 and a chip 212. In some implementations, the chip 212 may be a Bluetooth chip.

In some implementations, a signal from the control station 120 (e.g., a signal generated in response to the selection of a multi-function button of the control station 120) may be received at the operator control module 280 of the barrier operator 95 by the microcontroller 283. In an implementation in which the light fixture 118 is in wireless communication with the barrier operator 95, the chip 212 may send a wireless signal (e.g., via a Bluetooth connection, an RF connection, a Wi-Fi connection, etc.) to the light fixture 118 instructing the light fixture 118 to toggle between an on and off status, emit an acoustical signal, or perform any other function. In an implementation in which the light fixture 118 is in wired communication with the barrier operator 95, after receiving a signal from the control station 120, the microcontroller 283 may send a signal to the light fixture 118 instructing or causing the light fixture 118 to toggle between an on and off status, emit an acoustical signal, or perform any other function.

In some implementations, the microcontroller 283 may also be referred to as a door controller. The chip 212 may also be referred to as a controller. In some implementations, the light fixture 118 may include a work light 298 as well as the sounder 299 previously described.

In some implementations, one or more hand-held or vehicle-mounted RF transmitters 291 proximate to the moveable barrier 195 may also transmit door commands to the operator control module 280 in a manner similar to that of the control station 120. In some implementations, the RF transmitter 291 is one example of the remote console 128 described with reference to FIG. 1, and the remote console 128 may be used in place of the RF transmitter 291.

In one example, the control station 120 may be configured to receive an "open" input from a user. The control station 120 may transmit a signal to the operator control module 280 in response to receiving this "open" input. This signal may be received by the microcontroller 283. The operator control module 280 may then transmit a door command to the motor assembly 263 to move the moveable barrier 195 to an open position. The operator control module 280 may simultaneously send a light command (e.g., by the microcontroller 283 or the chip 212), either wirelessly or otherwise, to the light fixture 118 to toggle the light to an "on" status.

In another example, the control station 120 may be configured to receive a "close" input from a user. The control station 120 may transmit a signal to the operator control module 280 in response to receiving this "close" input. This signal may be received by the microcontroller 283. The operator control module 280 may then transmit a door command to the motor assembly 263 to move the moveable barrier 195 to a closed position and simultaneously send a light command (e.g., by the microcontroller 283 or the chip 212), either wirelessly or otherwise, to the light fixture 118 to toggle the light to an "on" status.

In another example, the control station 120 may be configured to receive an additional input from a user, different from the "open" input and "close" input described previously. In some implementations, this additional input may be a "stop" input. In some implementations, this additional input may be a selection of a multi-function button. The control station 120 may transmit a signal to the operator control module 280 in response to receiving this additional input. This signal may be received by the microcontroller 283. The operator control module 280, or a processor circuit of the operator control module 280, may perform different functions in response to this additional signal from the control station 120 depending on the status of the moveable barrier 195 and/or the auto-close timer.

In one example, in response to receiving a signal corresponding to the selection of a multi-function button the control station 120, the operator control module 280 may request and/or receive barrier status information from, e.g., the motor assembly 263. This door status information may include information regarding whether the barrier is currently in motion or stationary. If the barrier status information indicates that the moveable barrier 195 is in motion, the operator control module 280 may issue a command to the motor assembly 263 to disengage or otherwise stop movement of the moveable barrier 195. If, however, the barrier status information indicates that the moveable barrier 195 is stationary (e.g., in either a closed or an open position), the operator control module 280 may determine the status of the auto-close timer. The status of the auto-close timer may include information as to whether the timer is active or inactive. If the status of the auto-close timer indicates that the auto-close timer is active, the operator control module 280 may stop or deactivate the auto-close timer. In this case, the moveable barrier 195 may be in an open position and the operator control module 280 will not move the moveable barrier 195 to a closed position after the time elapsed since the moveable barrier 195 assumed an open position meets or exceeds the threshold time because the auto-close timer was deactivated. If, however, the status of the auto-close timer is inactive, the operator control module 280 may send a light command to the light fixture 118 to toggle the light status.

To toggle the light status of the light fixture 118 may include switching to an "on" status if the light fixture 118 is currently in an "off" status and switching to an "off" status if the fixture 118 is currently in an "on" status.

Figure 3:
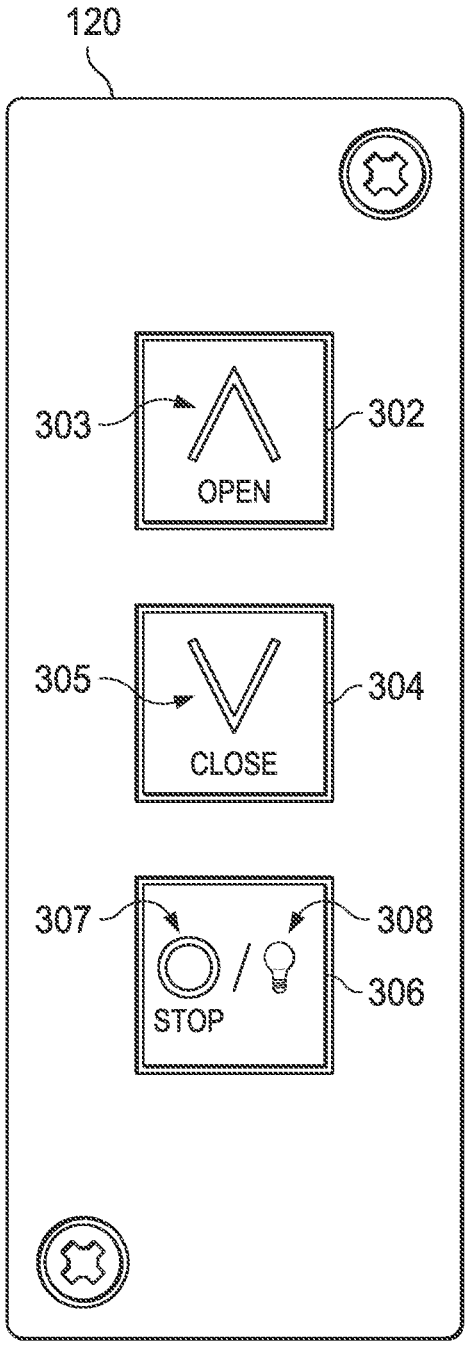
FIG. 3 is a diagrammatic view of a control station of the moveable barrier system, according to aspects of the present disclosure.

FIG. 3 is a diagrammatic view of an example of the control station 120 of the barrier system 100, according to aspects of the present disclosure. The control station 120 may include three buttons, an open button 302, a close button 304, and a multi-function button 306. Referring back to the description of FIG. 2, the multi-function button may refer to the multi-function button 306.

As shown in FIG. 3, any of the open button 302, the close button 304, and/or the multi-function button 306 may be of any suitable appearance. As an example, the buttons 302, 304, and/or 306 may be of a square shape. However, in other implementations, any of these buttons may be of any suitable shape, including symmetrical, geometric, or non-geometric shapes. The buttons 302, 304, and/or 306 may include any suitable depictions on surfaces of the buttons. As an example, the open button 302 may include a visual representation 303, including a symbol representative of an upward direction, such as an arrow or other symbol, or any other graphical representation. The open button 302 may additionally or alternatively include any suitable alphanumeric text, such as, for example, "OPEN" or any other text.

Similarly, the close button 304 may include any suitable depictions including the visual representation 305, or other graphical representations or alphanumeric text. As an example, the close button 304 may include a downward arrow or symbol and the text "CLOSE."

Similarly, the multi-function button 306 may include any suitable depictions including graphical representations or alphanumeric text. In some implementations, the multi-function button 306, as well as the open button 302 and the close button 304, may include depictions related to the function of the respective button. In this way, the multi-function button 306 may include depictions related to the various functions performed or initiated by the multi-function button 306. As shown in FIG. 3, the multi-function button 306 may include a graphical representation 307 corresponding to stopping the movement of the moveable barrier 195 (FIG. 1) as well as alpha-numeric text indicating the same, such as the text, "STOP." The multi-function button 306 may additionally include other depictions, such as the graphical representation 308 depicting of a light corresponding to the functionality of the multi-function button 306 to turn the light fixture 118 off or on. In some implementations, the multi-function button 306 may alternatively or additionally include depictions related to stopping a timer, such as the auto-close timer described with reference to FIG. 2.

It is noted that the any of the buttons 302, 304, and/or 306, as well as any additional buttons of the control station 120 may include any suitable types of buttons. For example, the buttons of the control station 120 may include physical buttons (e.g., displaceable push-buttons) configured to be depressed or recessed within the control station 120. In some implementations, the buttons of the control station 120 may be of the same unitary structure as the control station 120 or may be separate components or parts of the control station 120. In some implementations, the control station 120 may include a touch screen or other screen display. In such implementations, the buttons of the control station 120 may not be physical buttons, but rather portions of a graphical user interface displayed by the control station 120.

In some implementations, the control station 120 may receive a user input in any other way. For example, the control station 120 may be configured to receive voice commands or other auditory commands, inputs, or signals. The control station 120 may be configured to receive a signal from a remote device (e.g., the remote console 128 of FIG. 1), such as a smart phone, tablet, computer, a transmitter or transponder, such as an RF transmitter, or any other device.

In some implementations, the control station 120 may provide feedback in response to receiving a user input. For example, this feedback may include visual feedback, such as a light signal, a haptic signal, an auditory signal, or any other feedback.

The control station 120 may be configured to receive a user input via a common input mechanism. For purposes of the present invention, a common input mechanism may include any input device. An input device may include a button, a switch, a toggle, a slider, a knob, a breaker, or any similar device. Any of these devices may take any form, including a physical input device, a digital input device, an input device displayed as part of a screen display, an input device of a graphical user interface, an input device displayed on a touch screen, or any other form. A common input mechanism may also include a device configured for receiving one or more voice commands, a mechanism configured for receiving a wireless signal, or any other device. In some implementations, the control station 120 may include a plurality of input mechanisms including a plurality of different types of input mechanisms. In this way, an input mechanism may be a portion of a control station, such as a portion of a user interface.

Figure 4:
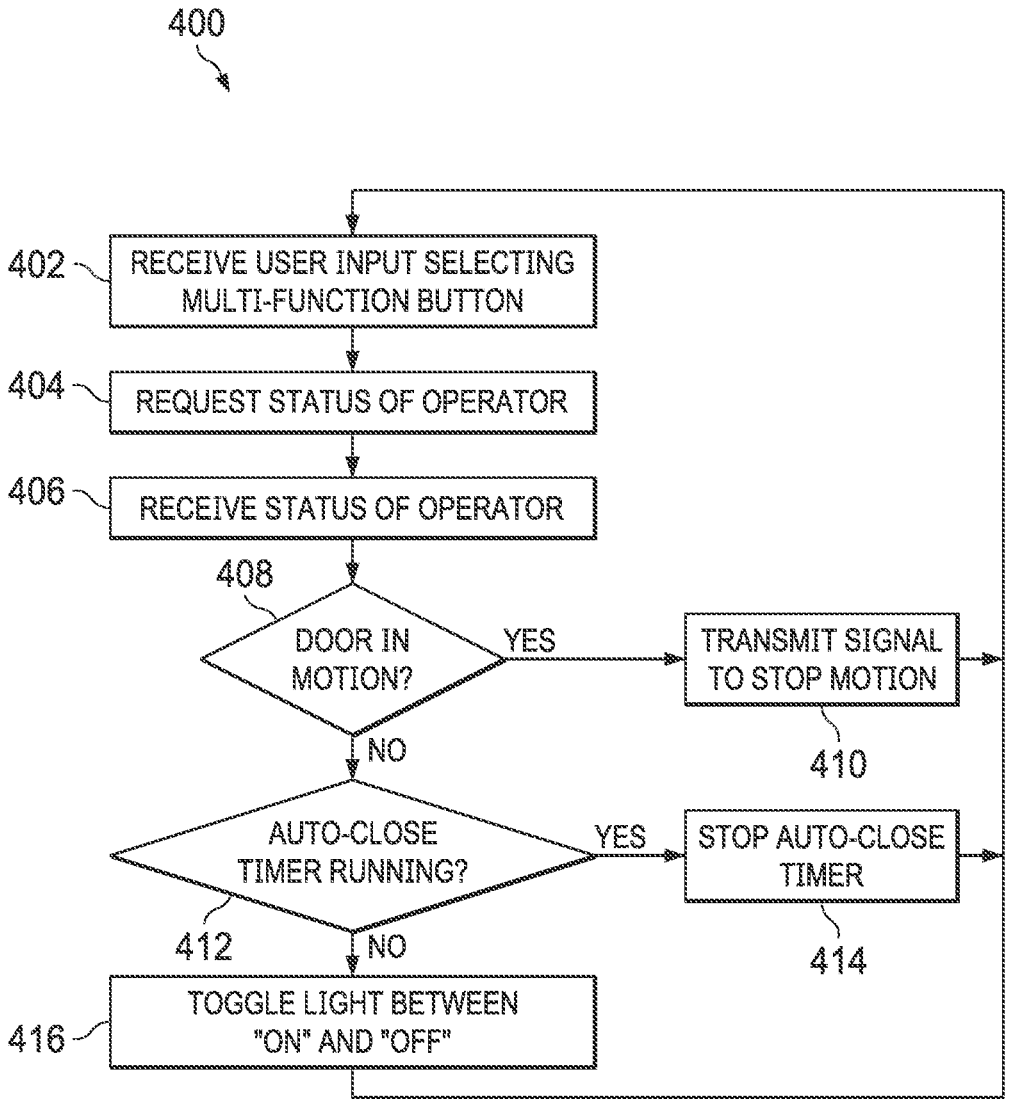
FIG. 4 is a flow-chart of a method of operating a multi-function button of a moveable barrier system, according to aspects of the present disclosure.

FIG. 4 is a flow-chart of a method 400 of operating a multi-function button (e.g., the multi-function button 306) of a barrier system (e.g., the barrier system 100), according to aspects of the present disclosure. As illustrated, the method 400 includes a number of enumerated steps, but implementations of the method 400 may include additional steps before, after, or in between the enumerated steps. In some implementations, one or more of the enumerated steps may be omitted, performed in a different order, or performed concurrently. The steps of the method 400 can be carried out by any suitable component within the barrier system 100 and all steps need not be carried out by the same component.

At step 402, the method 400 includes receiving a user input selecting a multi-function button. The multi-function button may be the multi-function button 306 described with reference to FIG. 3. In some implementations, the multi-function button may be a stop button. The user input received at step 402 of the method 400 may be any of the user inputs described with reference to the control station 120 of FIG. 3.

In one example, step 402 includes receiving a push of the multi-function button 306 of the control station 120 in communication with the barrier operator 95 or the operator control module 280 of the barrier operator 95. In one example, the control station 120 may transmit a signal from the control station 120 to the operator control module 280 of the barrier operator 95 after receiving the user input.

At step 404, the method 400 includes requesting the status of the operator. In some implementations, requesting the status of the operator may include a signal sent from the operator control module 280 of the barrier operator 95 to various components in communication with the operator control module 280.

The status of the operator may include a status regarding the position and movement of a barrier (e.g., the moveable barrier 195) and a status regarding an auto-close timer. The status of the moveable barrier 195 may include whether the moveable barrier 195 is in motion or is stationary. In some implementations, the status of moveable barrier 195 may also include whether the moveable barrier 195 is in an open position or a closed position. In some implementations, a status of the moveable barrier 195 may include whether the barrier is currently moving from a closed to an open position or from an open to a closed position. In some implementations, the status of the moveable barrier 195 may include at what position between an open and a closed position the moveable barrier 195 is currently positioned. The status of the auto-close timer may include whether the auto-close timer is active or inactive, a current elapsed time of the auto-close timer, a threshold time corresponding to the time at which the barrier will be moved to a closed position, or any other status information.

In some implementations, the operator control module 280 will request a status of the moveable barrier 195 from a motor assembly (e.g., the motor assembly 263). In some implementations, the operator control module 280 will request a status of the auto-close timer from an auto-close timer module. In some implementations, the operator control module 280 may implement the auto-close timer and may pull auto-close timer status information from the implementation.

At step 406, the method 400 includes receiving a status of the operator. The status of the operator may include any status information described with reference to step 404. Elements of the status of the operator may be received by the operator control module 280 (FIG. 2) from the motor assembly 263 (FIG. 2), the auto-close timer module, and/or the operator control module 280.

At step 408, the method 400 includes determining whether the moveable barrier 195 is in motion. This determination may be made based on an analysis of the status of the moveable barrier 195 information of the status of the operator information described with reference to steps 404 and 406.

In an implementation in which the moveable barrier 195 is in motion at the time the user input was received at step 402, the status of the moveable barrier 195 may indicate that the moveable barrier 195 is in motion. As a result, the method 400 may progress to step 410. In an implementation in which the moveable barrier 195 is not in motion at the time the user input was received at step 402, the status of the moveable barrier 195 may indicate that the moveable barrier 195 is not in motion. As a result, the method 400 may progress to step 412.

At step 410, the method 400 includes transmitting a signal to stop motion of the moveable barrier 195. In one example, the operator control module 280 may transmit a signal to a motor assembly (e.g., the motor assembly 263 of FIG. 2) causing the motor assembly 263 to stop the movement of the moveable barrier 195.

As shown in FIG. 4, after a signal is sent to stop the motion of the moveable barrier 195 (e.g., a signal from the operator control module 280 to the motor assembly 263), the method 400 may again return to the step 402. In this way, the method 400 may illustrate a continuous loop. For example, the components of the barrier system 100 described herein may receive multiple inputs in succession, as will be explained hereafter.

At step 412, the method 400 includes determining whether an auto-close timer is running. For example, the method 400 may proceed from the step 408 to the step 412 in response to determining, at the step 408, that the moveable barrier 195 is not in motion. At step 412, the operator control module 280 configured to maintain an auto-close timer may determine whether the auto-close timer is active or inactive. In an implementation in which the auto-close timer is active, the method 400 may progress from the step 412 to the step 414. In an implementation in which the auto-close timer is not active, the method 400 may progress from the step 412 to the step 416.

At step 414, the method 400 includes stopping the auto-close timer. In some implementations, the step 414 may include transmitting a signal from the operator control module 280. In other implementations, the operator control module 280 may stop the auto-close timer. In response to the auto-close timer being stopped, the barrier operator (e.g., the barrier operator 95 of FIG. 1) may not cause the moveable barrier 195 to be moved to a closed position when the amount of time the moveable barrier 195 has been in an open position meets or exceeds a threshold time.

Similar to the step 410, after the step 414 is completed, the method 400 may revert back to the step 402. In this way, the method 400 may illustrate a continuous loop.

At step 416, the method 400 includes toggling the light between an on and an off status. For example, if at the step 416, the light (e.g., the light fixture 118) is off, the barrier operator 95 may cause the light fixture 118 to turn on. By contrast, if at the step 416, the light fixture 118 is off, the barrier operator 95 may cause the light fixture 118 to turn off. The method 400 may proceed from the step 412 to the step 416 in response to determining, at the step 412, that the auto-close timer is not active or is not running. Similar to the steps 410 and 414, after the step 416 is completed, the method 400 may revert back to the initial step 402 forming a continuous loop.

Aspects of the method 400 will now be explained with three particular example scenarios, each of which corresponding to a different state of the moveable barrier 195 at the time a user input selecting the multi-function button 306 is received. It is noted that the example scenarios provided herein are merely exemplary and provided for pedagogical purposes only. The example scenarios provided are not intended to be limiting.

As a first example, the moveable barrier 195 may be in motion at the time a user input selecting the multi-function button 306 is received. At the steps 404 and 406, the barrier operator 95 may acquire the status of the operator, including the status of the moveable barrier 195. Because the moveable barrier 195 is in motion, at step 408, the method 400 may proceed to the step 410. At the step 410, the moveable barrier 195 may be stopped. If an additional user input is received selecting the multi-function button 306, because the moveable barrier 195 was stopped, the method 400 will progress to the step 412 from the step 408. In this first example, because the moveable barrier 195 was initially in motion and was then stopped, it is not in an open position and the auto-close timer is not active. As a result, at the step 412, the method progresses to the step 416 and the light is toggled on or off. In summary, if the moveable barrier 195 is in motion at an initial step 402, pressing the multi-function button 306 once causes the moveable barrier 195 to stop and pressing the multi-function button 306 a second time causes the light fixture 118 to toggle on or off Additional selections of the multi-function button 306 will also toggle the light fixture 118 on or off.

As a second example, the moveable barrier 195 may be stationary and in a closed position. In this second example, if the barrier system 100 receives a user input selecting the multi-function button 306 at the step 402, the method may acquire the status of the operator at the steps 404 and 406.

Because the moveable barrier 195 is stationary and closed, at the step 408, the method may progress to the step 412. Because the moveable barrier 195 is closed, the auto-close timer is not running, so the method may proceed from the step 412 to the step 416 and the light fixture 118 may be toggled on or off. In summary, if the barrier is in a closed position and not in motion, pressing the multi-function button 306 once toggles the light fixture 118 from an off to an on status or vice versa. Any additional selections of the multi-function button 306 may, therefore, also toggle the light fixture 118.

As a third example, the moveable barrier 195 may be stationary and in an open position. In this third example, if the barrier system 100 receives a user input selecting the multi-function button 306 at the step 402, the method 400 may acquire the status of the operator at the steps 404 and 406. Because the moveable barrier 195 is stationary and open, at the step 408, the method may progress to the step 412. In an open position, the auto-close timer may be active or inactive depending on the length of time the moveable barrier 195 has been in the open position. For the purposes of this third example, it assumed that the auto-close timer is active, meaning the auto-close timer has not met or exceeded the threshold time. In this case, the method 400 may proceed to the step 414 of the method 400 at which the auto-close timer is deactivated, and the method reverts back to the step 402. If an additional selection of the multi-function button 306 is received, the status of the operator may again be acquired at the steps 404 and 406. Because the moveable barrier 195 is still open, the method 400 proceeds from step 408 to step 412. At the step 412, because the auto-close timer was deactivated, the method 400 may proceed to the step 416. At step 416, the light fixture 118 may be toggled on or off. In summary, if the moveable barrier 195 is in an open position and not in motion, and if the auto-close timer is active, pressing the multi-function button 306 once deactivates the auto-close timer. Pressing the multi-function button 306 a second time then toggles the light fixture 118 from an off to an on status or vice versa. Additional selections of the multi-function button 306 may also toggle the light fixture 118.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A moveable barrier system comprising:
- a moveable barrier configured to provide selective access to a space;
- a barrier operator configured to manipulate the moveable barrier between a closed position and an open position;
- a light; and
- a control station comprising a multi-function button configured to initiate more than one action by the barrier operator and by the light, the multi-function button being configured to initiate actions of:
  - stopping an auto-close timer in response to receiving a first user input at the multi-function button; and
  - toggling the light between an off state and an on state in response to receiving a second user input at the multi-function button.

2. The system of claim 1, wherein the multi-function button is configured to further initiate an action of stopping a movement of the moveable barrier in response to receiving a third user input at the multi-function button.

3. The system of claim 1, wherein: the control station is configured to send a signal to the barrier operator in response to receiving the first user input; and the barrier operator is configured to stop the auto-close timer in response to receiving the signal from the control station.

4. The system of claim 1, wherein:
- the control station is configured to send a first signal to the barrier operator in response to receiving the second user input;
- the barrier operator is configured to send a second signal to the light in response to receiving the first signal from the control station; and
- the light is configured to toggle between the off state and the on state in response to receiving the second signal from the barrier operator.

5. The system of claim 1, wherein:
- the control station is configured to send a signal to the light in response to receiving the second user input; and
- the light is configured to toggle between the off state and the on state in response to receiving the signal from the control station.

6. The system of claim 1, wherein the control station is a wall console.

7. The system of claim 1, wherein the control station is a remote input device configured to wirelessly communicate with the barrier operator.

8. The system of claim 1, wherein the light is configured to wirelessly communicate with the barrier operator.

9. The system of claim 1, wherein the barrier operator is further configured to automatically start the auto-close timer after moving the moveable barrier to the open position.

10. The system of claim 1, wherein the multi-function button is one of a physical button and a selectable image on a display.

11. The system of claim 1, wherein the multi-function button is configured to further initiate an action of stopping an auto-close timer in response to receiving a third user input at the multi-function button.

12. A moveable barrier system comprising:
- a moveable barrier configured to provide selective access to a space;
- a barrier operator configured to manipulate the moveable barrier between a closed and an open position;
- a light; and
- a control station comprising a multi-function button configured to initiate more than one action by the barrier operator and by the light, the multi-function button being configured to initiate actions of:
  - stopping a movement of the moveable barrier in response to receiving a first user input at the multi-function button; and
  - toggling the light between an off state and an on state in response to receiving a second user input at the multi-function button.

13. The system of claim 12, wherein:
- the control station is configured to send a signal to the barrier operator in response to receiving the first user input; and the barrier operator is configured to stop the movement of the moveable barrier in response to receiving the signal from the control station.

14. The system of claim 12, wherein:

the control station is configured to send a first signal to the barrier operator in response to receiving the second user input;

the barrier operator is configured to send a second signal to the light in response to receiving the first signal from the control station; and the light is configured to toggle between the off state and the on state in response to receiving the second signal from the barrier operator.

15. The system of claim 12, wherein:

the control station is configured to send a signal to the light in response to receiving the second user input; and the light is configured to toggle between the off state and the on state in response to receiving the signal from the control station.

16. A method comprising:

receiving a user input at a control station in operative communication with a barrier operator;

in response to the user input, determining:

whether a moveable barrier configured to be manipulated by the barrier operator is in motion between an open position and a closed position;

a status of an auto-close timer corresponding to a length of time until the barrier operator closes the moveable barrier; and in response to determining that the moveable barrier is stationary and determining that the auto-close timer is inactive, toggling a light between an off state and an on state.

17. The method of claim 16, further comprising:

stopping a movement of the moveable barrier in response to the user input.

18. The method of claim 16, further comprising:

stopping the auto-close timer in response to the user input.

19. The method of claim 16, wherein the user input is received via a button of the control station.

20. The method of claim 16, wherein the user input is received via a common input mechanism.

* * * * *